US005352648A

United States Patent [19]

Chao

[11] Patent Number: 5,352,648

[45] Date of Patent: Oct. 4, 1994

[54] PRESSURE SENSITIVE COPYING PAPER WITH REPOSITIONABLE ADHESIVE PROPERTIES

[75] Inventor: Hung Y. Chao, Princeton Junction, N.J.

[73] Assignee: Moore Business Forms, Inc., Grand Island, N.Y.

[21] Appl. No.: 56,624

[22] Filed: May 4, 1993

[51] Int. Cl.[5] ..... B41M 5/165

[52] U.S. Cl. ..... 503/206; 503/214; 503/226

[58] Field of Search ..... 428/321.5; 503/214, 503/215, 226, 206

[56] References Cited

U.S. PATENT DOCUMENTS 3,993,299 11/1976 O'Brien et al. ..... 270/5
4,583,765 4/1986 Messinger ..... 282/9 R
4,593,935 6/1986 Kearns ..... 282/28 R
4,661,388 4/1987 Charbonneau ..... 428/321.5
4,714,276 12/1987 Greig ..... 283/63 R
4,798,401 1/1989 Greig ..... 282/9 R

FOREIGN PATENT DOCUMENTS 1007543 10/1965 United Kingdom .

*Primary Examiner*—Pamela R. Schwartz
*Attorney, Agent, or Firm*—Nixon & Vanderhye

[57] ABSTRACT

A pressure sensitive carbonless copying system includes a first sheet having front and back surfaces, the back surface coated at least in part with a composition including a mixture having a pressure sensitive adhesive component and a carbonless microcapsule component; and a second sheet having front and back surfaces, the front surface coated with a carbonless image transfer material, and wherein the first sheet is temporarily adhered to the second sheet by means of the pressure sensitive adhesive component of the mixture.

12 Claims, 1 Drawing Sheet

PRESSURE SENSITIVE COPYING PAPER WITH REPOSITIONABLE ADHESIVE PROPERTIES

RELATED APPLICATIONS

This invention relates to a pressure sensitive copying paper system that also has repositionable adhesive properties.

BACKGROUND AND SUMMARY OF THE INVENTION

It is, of course, well known in the art to provide pads of paper in which each sheet of a stack constituting a pad is provided on its underside with a marginal strip of non-drying, slightly tacky adhesive, also known as repositionable or light tack adhesive. This allows each sheet to be lightly and temporarily bonded to other surfaces including, initially, the top surface of an underlying similar sheet in the pad. See, for example, the Swiss patent to Eugster 452,479 dated May 31, 1986. The present assignee makes and sells under the NOTE-STIX ® name several varieties of note pads of the type described above.

It is also well known particularly in the business forms art, to provide multiple sheet business forms with carbonless (self-imaging) coatings for producing multiple copies of an original writing. See, for example, U.S. Pat. Nos. 3,981,523; 4,126,334 and 4,199,174, all assigned to the present assignee. Typical carbonless copying systems include a combination of adjacent cooperating CB and CF layers on adjacent sheets. For example, the bottom surface of the top sheet is typically coated with carbonless micro-capsules (the CB coating or layer) which burst upon the application of localized pressure, to transfer an image onto a resinous or clay coating (the CF coating or layer) provided on the top surface of a lower adjacent sheet. Other arrangements include a combined CB/CF coating on the top surface of the lower sheet, resulting in image transferal to the lower sheet upon original writing pressure applied to the top surface of the upper sheet. Combining the concepts of repositionable adhesives and carbonless coatings in a single system in a commercially acceptable format has yet to be achieved.

Attempts have been made, however, to combine carbonless copying with repositionable adhesive techniques, and these attempts are reflected in the patent literature. For example, in U.S. Pat. No. 4,583,776, there is disclosed a series of contact film type labels fastened together to form a label set. Each of the film labels is provided with light tack adhesive on one surface of the label, while disposed between the labels is a transfer film which allows a carbonizing image to be formed on the succeeding label. The patent discloses the use of separate adhesive and transfer layers, however, and does not represent a true combination of the concepts as in the present invention.

U.S. Pat. No. 4,798,401 also seeks to combine the concepts of repositionable adhesive and carbonless imaging. In this patent, separate layers of adhesive and transfer layers are utilized, and a divider is positionable beneath a selected number of sheets for blocking transfer of an image to the sheets underneath the divider.

U.S. Pat. No. 4,714,276 describes a pad provided with a stack of preprinted sheets, each sheet being serially connected to its neighboring sheets along a respective margin, by means of a strip of non-drying lightly tacky pressure sensitive adhesive. Discrete areas of one or more sheets within the pad also carry a regional coating of carbon type or carbonless pressure sensitive image transfer material adapted to produce on the respective underlying region of the upper surface of the respective next sheet an image of what is pressed onto the sheet from above.

In U.S. Pat. No. 4,593,935, a pad of stationery is provided which comprises a block of writing sheets, in combination with a copy sheet. The copy sheet has a first face which includes a CB coating while the second face has neither a CF coating nor a CB coating. The copy sheet is preferably provided atop the pad as a separately detachable sheet. Each of the writing sheets comprises an upper surface and a lower surface with the upper surface of each of the writing sheets comprising a CF coating. Thus, the copy sheet may be inserted between the uppermost one of the writing sheets and the next writing sheet with the first face of the copy sheet uppermost. Since no CF coating is adjacent disposed to a CB coating, no copy is made upon the next sheet in the pad. When it is desired to make a copy of a written record, the copy sheet is inserted between the uppermost one of the writing sheets and the next consequent writing sheet with the second face of the copy sheet uppermost. The CB coating of the copy sheet then lies adjacent to the CF coating of the next sheet in the pad and writing pressure upon the topmost writing sheet produces a copy in the underlying sheet.

In U.K. Patent 1,007,543, a pad of paper utilizing carbonless copy techniques is employed wherein selected surfaces of each sheet are located so as to prevent reproduction of certain information.

The present invention combines the concept of repositionable adhesive with pressure sensitive, non-carbonless copying in a manner which heretofore has not been available in commercially acceptable form.

In accordance with an exemplary embodiment of this invention, a pressure sensitive copying paper also has the capability of temporarily adhering to a substrate. More specifically, carbonless microcapsules which contain a colorless dye (the CB coating or layer) are blended with an acrylate type repositionable adhesive, then coated onto the lower or back surface of a sheet. The resultant sheet can be utilized as a regular repositionable adhesive sheet; however, when it is brought into contact with a carbonless image transfer material (e.g., a phenolic resin, clay coated or salicylic acid derivative) on an underlying sheet (the CF sheet) in a configuration normally associated with the pressure sensitive copying paper, an image can be formed on the CF sheet upon application of original writing pressure on the CB sheet. Image transfer thus occurs regardless of whether the original writing pressure is applied over an adhesive area on the underside of the CB sheet. Subsequently, the CB sheet can be pulled away from the CF sheet, and can be made to adhere to a different substrate in the usual manner of a repositionable note pad sheet. The presence of the elastic adhesive particles in the sheet further serve as an anti-offset material for the dye containing microcapsules.

Thus, in accordance with the broader aspects of the invention, there is provided a pressure sensitive carbonless copying system comprising a) a first sheet having front and back surfaces, the back surface coated with a composition including a pressure sensitive adhesive component and a carbonless microcapsule component; and b) a second sheet having front and back surfaces, the front surface coated with a carbonless image transfer material, and wherein the first sheet is temporarily adhered to the second sheet by means of the pressure sensitive adhesive component of the mixture.

In another aspect, the present invention relates to a pad comprising a plurality of note sheets, each note sheet having an upper surface and a lower surface, wherein at least a portion of the lower surface of each sheet is coated with a composition including a mixture having a pressure sensitive adhesive component and a microcapsule component; and wherein the upper surface of each sheet is at least partially coated with a carbonless image transfer material.

In still another aspect, the invention relates to a method of manufacturing a multi-part paper product having carbonless copying and repositionable adhesive properties comprising the steps of:

a) mixing a pressure sensitive adhesive component in slurry form with a carbonless microcapsule component, also in slurry form;
b) coating at least a portion of an underside of at least a first sheet with the mixture from step (a);
c) coating at least a portion of a top side of at least a second sheet with a carbonless image transfer material; and
d) adhering the underside of the first sheet to the top side of the second sheet.

The invention is applicable to various kinds of form constructions including two part business forms and multi-sheet note pads. These are merely exemplary, and the invention is not be considered as limited to only those specific examples described herein.

The invention thus provides an effective carbonless copy/repositionable adhesive pad or form in a simple, cost effective manner which eliminates the prior requirement of separate carbonless/adhesive layers.

Other objects and advantages of the invention will become apparent from the detailed description which follows.

DETAILED DESCRIPTION OF THE DRAWINGS

Figure 1:
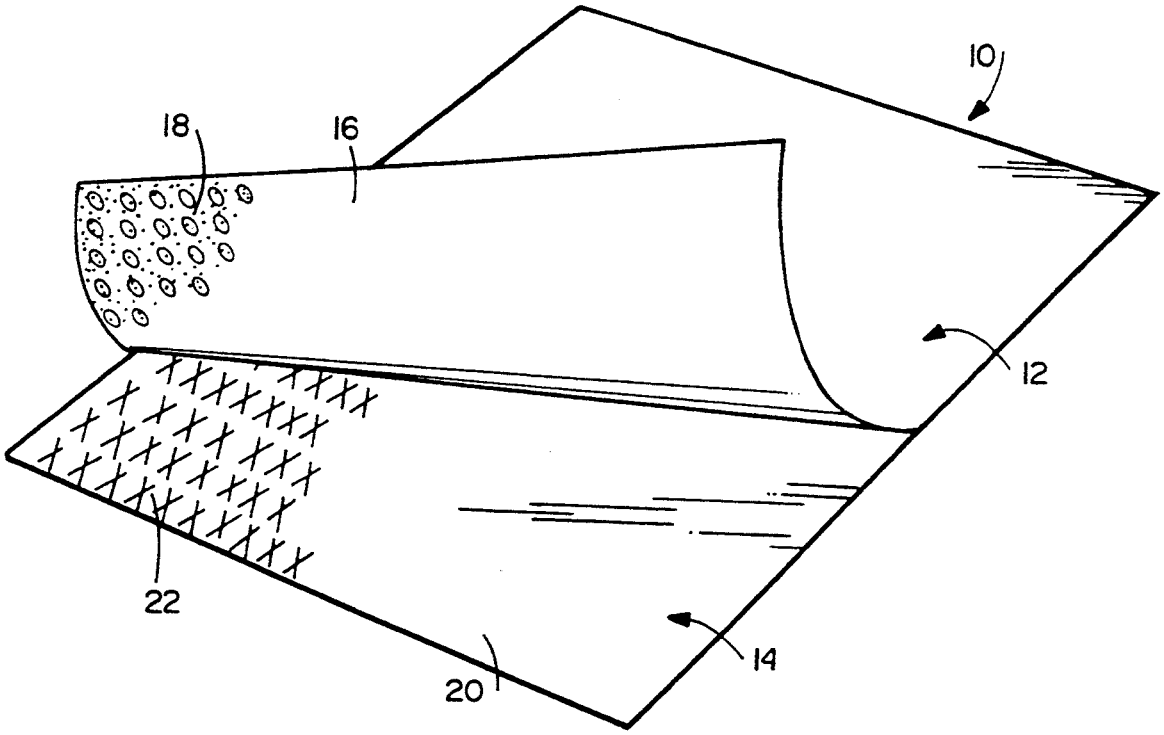
FIG. 1 is a perspective view of a two part form incorporating the subject matter of this invention.

With reference now to FIG. 1, a two part form 10 is shown which includes an upper sheet 12 and a lower sheet 14. The underside 16 of the upper sheet 12 is provided over its entire surface area with a combined CB/adhesive coating 18 in accordance with this invention, while the top surface 20 of the lower sheet 14 is provided over its entire surface area with a conventional CF (a phenolic resin, clay or salicylic derivative) coating 22.

Figure 2:
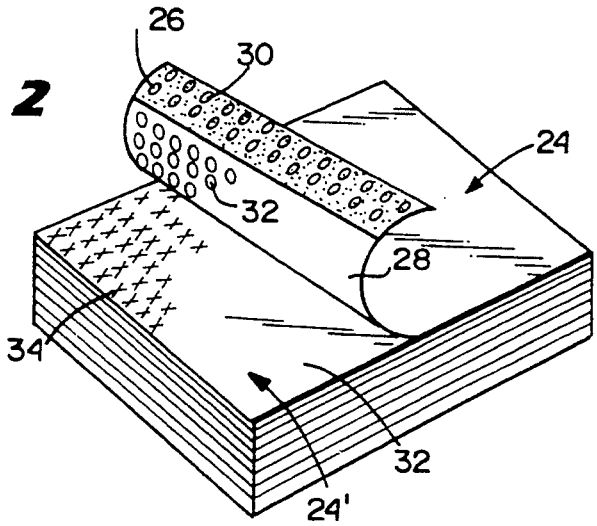
FIG. 2 is a perspective view of a pad of adhesively secured paper sheets in accordance with an alternative embodiment of the invention.

In another embodiment of the invention, as shown in FIG. 2, a plurality of individual sheets 24, 24', etc. are secured along one marginal edge as represented in FIG. 2 by the marginal edge 26 on the underside 28 of the uppermost sheet 24. This is a standard pad construction of the NOTE-STIX ® type but it also incorporates the subject matter of this invention as further described below. The underside 28 of sheet 24 is provided in the marginal edge area 26 with a combined CB/adhesive coating 30 similar to that described above with respect to FIG. 1 (element 18). The remaining area of the underside 28 of the sheet 24 is provided with a standard CB coating 32. At the same time, the upper surface 34 of the underlying sheet 24' is provided with a standard CF coating 34 over its entire surface area. In this arrangement, an image will be transferred to the surface 34 of the underlying sheet 24' upon the application of original writing pressure on the upper surface of the uppermost sheet 24. This is true regardless of whether tile writing pressure is applied in the marginal area 26 or in the remaining area of the sheet 24.

It will be appreciated that any number of adhesive patterns may be employed to adhere one sheet to another, but because of the blending or mixing of carbonless microcapsules into the adhesive, image transfer will occur regardless of the area of the top sheet in which the original writing pressure is applied.

A specific example of the combined CB/adhesive coating composition for use as coatings 18 and 30, and the manner in which it is prepared, is provided below.

In the preparation of a suitable repositionable adhesive, in terms of parts by weight 0.33 part of benzoyl peroxide was dissolved in 120 parts of EHA (2-ethyl hexylacrylate) and 30 parts of IBOA (isobornolacrylate). The mixture was emulsified into 150 parts of 2% Vinol 523 solution in a blender. The oil and water emulsion was observed to have a particle size distribution of between 2 to 100 microns, with an average of about 55 microns. Vinol 523 is a partially hydrolized polyvinyl alcohol, commercially available from Air Products and Chemicals.

The above identified mixture was heated to about 80° C. when a reaction exotherm was observed. After the reaction exotherm, the mixture was further heated to 90° C. for about two hours to complete the free radical polymerization. The solid content of the slurry was about 50%.

In the preparation of the CB component, again in terms of parts by weight, 6.52 parts of terephthaloyl chloride was dissolved in 63 parts of a 6% colorless dye in Sure Sol 330-alkylate 273 (1:3) oil solution. The mixture was emulsified into 130 parts of 2% Vinol 523 solution in a blender. To this emulsion, 20 parts of an aqueous solution containing 3.27 parts of diethylenetriamine, and 2.00 parts of sodium carbonate was added. The mixture was stirred at room temperature, under mild agitation, for 16 hours to complete the micro encapsulation reaction. Particle size varied from about 0.5 to 20 microns, with an average of about 4 microns. The slurry was observed to have a solid content of about 36%.

The above described adhesive slurry (A) was then mixed with the above described microcapsule slurry (B) at ratios of from 1:9 to about 5:5, and coated on a substrate such as a 20# bond paper, at a coating weight of about 2–6 g/m$^2$. The CB sheet was then laminated with a phenolic resin coated CF sheet. A calendar tester on the back side of the CB pressed against the CF and formed an image on the CF. The following results were observed:

TABLE I

| A:B | Image Intensity | Blush |
|---|---|---|
| 0:10 | 27 | 5 (severe) |
| 1:9 | 27 | 5 (severe) |
| 2:8 | 26 | 3 (medium) |
| 3:7 | 28 | 3 (medium) |
| 4:6 | 31 | 1 (very light) |

TABLE I-continued

| A:B | Image Intensity | Blush |
|---|---|---|
| 5:5 | 30 | 0 (none) |

Surprisingly, the presence of the adhesive particles do not significantly affect the capsule imaging capability, as indicated by the narrow image intensity ban in Table I. The adhesive particles have also been found to prevent the microcapsules from accidental damage during coating, handling, storage, etc. This is shown in the blush test results which are also shown above in Table I, the best results noted at a 5:5 ratio of adhesive component to carbonless microcapsule component.

Another laminate was tested with a standard Tag and Label Manufacturers Institute (TLMI) peel test for adhesives. The CB sheet was pulled away from the CF sheet at a 90° angle and the delaminating force was measured. The CB sheets were then further tested against a standard stainless steel plate for peel strength. The following results were observed.

TABLE II

| A:B | Delam (oz/in$^2$) | SS Peel (oz/in$^2$O) |
|---|---|---|
| 1:9 | 2.08 | 0.16 |
| 2:8 | 2.87 | 0.46 |
| 3:7 | 5.42 | 1.03 |
| 4:6 | 6.04 | 1.00 |
| 5:5 | 8.56 | 1.69 |

From the above, it may be concluded that a CB/adhesive ratio of from about 3:7 to 5:5 provides the best all around results in terms of imaging and adhesive characteristics.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pressure sensitive carbonless copying system comprising:

a) a first sheet having front and back surfaces, said back surface coated at least in part with a composition including a mixture having a pressure sensitive adhesive component and a carbonless coating component including microcapsules containing a colorless dye; and b) a second sheet having front and back surfaces, said front surface coated with a carbonless image transfer material for cooperation with said carbonless coating component to enable an image to be transferred to said second sheet upon application of localized pressure to said first sheet and wherein said first sheet is temporarily adhered to said second sheet by means of said pressure sensitive adhesive component of said mixture.

2. The pressure sensitive carbonless copying system of claim 1 wherein said back surface of said first sheet is substantially entirely covered by said composition.

3. The pressure sensitive carbonless copying system of claim 2 wherein said carbonless image transfer material comprises phenolic resin.

4. The pressure sensitive carbonless copying system of claim 1 wherein said pressure sensitive adhesive component comprises an acrylate repositionable adhesive.

5. The pressure sensitive carbonless copying system of claim 4 wherein said pressure sensitive adhesive component comprises a copolymer of, in parts by weight:

120 parts of 2-ethyl-hexylacrylate and 30 parts of isobornyl acrylate emulsified in polyvinyl alcohol.

6. The pressure sensitive carbonless copying system of claim 1 wherein the ratio of pressure sensitive adhesive component to carbonless microcapsule component is at least about 3:7.

7. A pad comprising a plurality of note sheets, each note sheet having an upper surface and a lower surface, wherein at least a portion of the lower surface of each sheet is coated with a composition including a mixture having a pressure sensitive adhesive component and a carbonless component including microcapsules containing a colorless dye; and wherein the upper surface of each sheet is at least partially coated with a carbonless image transfer material for cooperation with said carbonless coating component to enable an image to be transferred to said second sheet upon application of localized pressure to said first sheet.

8. The pad of claim 7 wherein said portion of said lower surface extends along a marginal edge of the sheet.

9. The pad of claim 8 wherein said lower surface is coated with microcapsules alone in all areas other than said portion.

10. The pad of claim 7 wherein said pressure sensitive adhesive component comprises an acrylate repositionable adhesive.

11. The pad of claim 7 wherein said pressure sensitive adhesive component comprises:

a copolymer of, in parts by weight:

120 parts of 2-ethyl-hexylacrylate and 30 parts of isobornyl acrylate emulsified in polyvinyl alcohol.

12. The pressure sensitive carbonless copying system of claim 7 wherein the ratio of pressure sensitive adhesive component to carbonless microcapsule component is at least about 3:7.

* * * * *